US006256787B1

(12) United States Patent
Tyler

(10) Patent No.: US 6,256,787 B1
(45) Date of Patent: Jul. 10, 2001

(54) INFLATABLE SUPPORT FOR LOWER LEGS

(76) Inventor: Paul Tyler, 11401 Golf Links Rd., Oakland, CA (US) 94605

( * ) Notice: Subject to any disclaimer, the term of this patent is extended or adjusted under 35 U.S.C. 154(b) by 0 days.

(21) Appl. No.: 09/741,463

(22) Filed: Dec. 19, 2000

(51) Int. Cl.[7] ..... A41D 13/06
(52) U.S. Cl. ..... 2/22; 2/DIG. 3; 602/13
(58) Field of Search ..... 2/22, 23, 24, 62, 2/455, 16, 267, 413, 911, DIG. 3; 128/882; 602/13, 23, 26, 62

(56) References Cited

U.S. PATENT DOCUMENTS

| | | | | |
|---|---|---|---|---|
| 871,760 | * | 11/1907 | Long | 2/24 |
| 1,055,040 | * | 3/1913 | Herron et al. | 2/24 |
| 4,266,298 | * | 5/1981 | Graziano | 2/22 |
| 4,453,271 | * | 6/1984 | Donzis | 2/455 |
| 4,772,071 | | 9/1988 | Richards . | |
| 5,090,055 | | 2/1992 | McElroy . | |
| 5,383,843 | | 1/1995 | Watson et al. . | |
| 5,385,538 | | 1/1995 | Mann . | |
| 5,407,421 | | 4/1995 | Goldsmith . | |
| 5,491,840 | | 2/1996 | Yen . | |
| 5,524,292 | | 6/1996 | Hargens . | |
| 5,911,310 | * | 6/1999 | Bridgers | 2/22 |

* cited by examiner

*Primary Examiner*—John J. Calvert
*Assistant Examiner*—Tejash Patel
(74) *Attorney, Agent, or Firm*—Goldstein Law Offices P.C.

(57) ABSTRACT

An inflatable support for lower legs including a knee support adapted for receiving a knee therein. A lower leg and foot support is secured to the knee support. The lower leg and knee support is comprised of a tubular member capable of being filled with a selected material. The tubular member is arranged to define an upper shin support, a lower floor support, and a bend positionable within an arch between a foot and an ankle. The tubular member is positionable along the lower leg and foot to evenly distribute the weight thereof as applied when in kneeling position. A heat retaining bladder is coextensive with the tubular member to impart heat the the lower leg directly and indirectly through the tubular member.

11 Claims, 4 Drawing Sheets

INFLATABLE SUPPORT FOR LOWER LEGS

BACKGROUND OF THE INVENTION

The present invention relates to an inflatable support for lower legs and more particularly pertains to protecting a person's knees, shins, and feet while kneeling on a hard surface.

In many professions, it is necessary for workers to kneel on hard surfaces for extended periods of time. Because of the positioning of the knee and shin on the hard surface when kneeling, an individual must endure discomfort and possibly injury when kneeling for any prolonged length of time. Although some devices have been constructed to offer some degree of comfort, they are seemingly inadequate in providing maximum comfort to the wearer through effective distribution of the pressure applied to the knee and leg when kneeling on hard surfaces. Therefore, it is necessary to provide a device that will provide support to the knees and shins of a person kneeling on a hard surface.

In addition, when kneeling the worker has a tendency to put a great deal of pressure on the toes. Also, the toes are flexed toward hyper-extension. Long term, such tension can be harmful. Accordingly, it is necessary to provide a device which supports the foot and prevents the worker's weight from being supported upon the toes in the manner previously described.

Further, at construction sites in particular, the workers are often forced to kneel upon an extremely cold ground surface. In many cases the ground surface can be well below freezing. Even while wearing warm clothes, the cold ground can easily conduct significant heat away from the body. Coupled with the pressure upon the legs from the weight of the worker, blood circulation can be inhibited to dangerous levels.

The present invention attempts to solve the abovementioned problem by providing a device that is specifically designed for protecting the knees, shins, and feet of a person kneeling on a hard surface for an extended period of time. In addition, it can help reduce heat conduction from the body by providing an effective barrier between the ground and leg, and can even hold a quantity of heat in a thermal medium which is slowly released to the worker.

The use of protective devices is known in the prior art. More specifically, protective devices heretofore devised and utilized for the purpose of providing protection to the human body are known to consist basically of familiar, expected and obvious structural configurations, notwithstanding the myriad of designs encompassed by the crowded prior art which have been developed for the fulfillment of countless objectives and requirements.

By way of example, U.S. Pat. No. 5,491,840 to Yen discloses a buffer structure for shin protection and ankle sleeve mat for use while participating in sporting events. U.S. Pat. No. 5,524,292 to Hargens discloses a knee pad unit having a plurality of inflatable pneumatic tubes attached within a shell. U.S. Pat. No. 4,772,071 to Richards discloses knee pads utilizing a seat to support the buttocks of the user. U.S. Pat. No. 5,090,055 to McElroy discloses an air cushion kneeling pad comprised of a one-piece molded resilient polyurethane foam. U.S. Pat. No. 5,383,843 to Watson et al. discloses an air pressure knee brace apparatus comprised of a flexible material wrap. U.S. Pat. No. 5,385,538 to Mann discloses a knee brace having an inflatable bladder support comprised of a cloth body having a central knee hole wrapped around a patient's knee to treat knee flexion contractures. U.S. Pat. No. 5,407,421 to Goldsmith discloses a compressive brace including one or more inflatable bladders equipped with an automatic, regulated, and removable air pressure regulation valve, where different valves have different release settings.

While these devices fulfill their respective, particular objective and requirements, the aforementioned patents do not describe an inflatable support for lower legs for protecting a person's knees and shins while kneeling on a hard surface.

In this respect, the inflatable support for lower legs according to the present invention substantially departs from the conventional concepts and designs of the prior art, and in doing so provides an apparatus primarily developed for the purpose of protecting a person's knees and shins while kneeling on a hard surface.

Therefore, it can be appreciated that there exists a continuing need for a new and improved inflatable support for lower legs which can be used for protecting a person's knees, shins, and ankles while kneeling on a hard surface. In this regard, the present invention substantially fulfills this need.

SUMMARY OF THE INVENTION

In the view of the foregoing disadvantages inherent in the known types of protective devices now present in the prior art, the present invention provides an improved inflatable support for lower legs. As such, the general purpose of the present invention, which will be described subsequently in greater detail, is to provide a new and improved inflatable support for lower legs which has all the advantages of the prior art and none of the disadvantages.

To attain this, the present invention essentially comprises a knee support adapted for receiving a knee therein. The knee support includes a rigid outer shell for positioning on a hard surface and a padded inner layer to provide comfort to the knee. A lower leg and foot support is secured to the knee support. The lower leg and knee support is comprised of a tubular member capable of being filled with a selected material. The tubular member has a valve exposing a hollow interior. The tubular member is arranged in a matrix defining an upper shin support, a lower floor support, and a bend positionable within an arch between a foot and an ankle. The tubular member is positionable along the lower leg and foot to evenly distribute the weight thereof as applied when in kneeling position. A pair of leg straps are secured to the lower floor support of the lower leg and foot support. The pair of leg straps each have opposed ends extending outwardly from the lower floor support. The opposed ends each have hook and loop fastener patches disposed thereon for engaging one another once the pair of leg straps have been wrapped around the lower leg.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved inflatable support for lower legs which has all the advantages of the prior art protective devices and none of the disadvantages.

It is another object of the present invention to provide a new and improved inflatable support for lower legs which may be easily and efficiently manufactured and marketed.

It is a further object of the present invention to provide a new and improved inflatable support for lower legs which is of durable and reliable construction.

An even further object of the present invention is to provide a new and improved inflatable support for lower legs which is susceptible of a low cost of manufacture with regard to both materials and labor, and which accordingly is then susceptible of low prices of sale to the consuming public, thereby making such an inflatable support for lower legs economically available to the buying public.

Even still another object of the present invention is to provide a new and improved inflatable support for lower legs for protecting a person's knees and shins while kneeling on a hard surface.

Lastly, it is an object of the present invention to provide a new and improved inflatable support for lower legs including a knee support adapted for receiving a knee therein. A lower leg and foot support is secured to the knee support. The lower leg and knee support is comprised of a tubular member capable of being filled with a selected material. The tubular member is arranged in a matrix defining an upper shin support, a lower floor support, and a bend positionable within an arch between a foot and an ankle. The tubular member is positionable along the lower leg and foot to evenly distribute the weight thereof as applied when in kneeling position.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various figures.

DESCRIPTION OF THE PREFERRED EMBODIMENT

Figure 1:
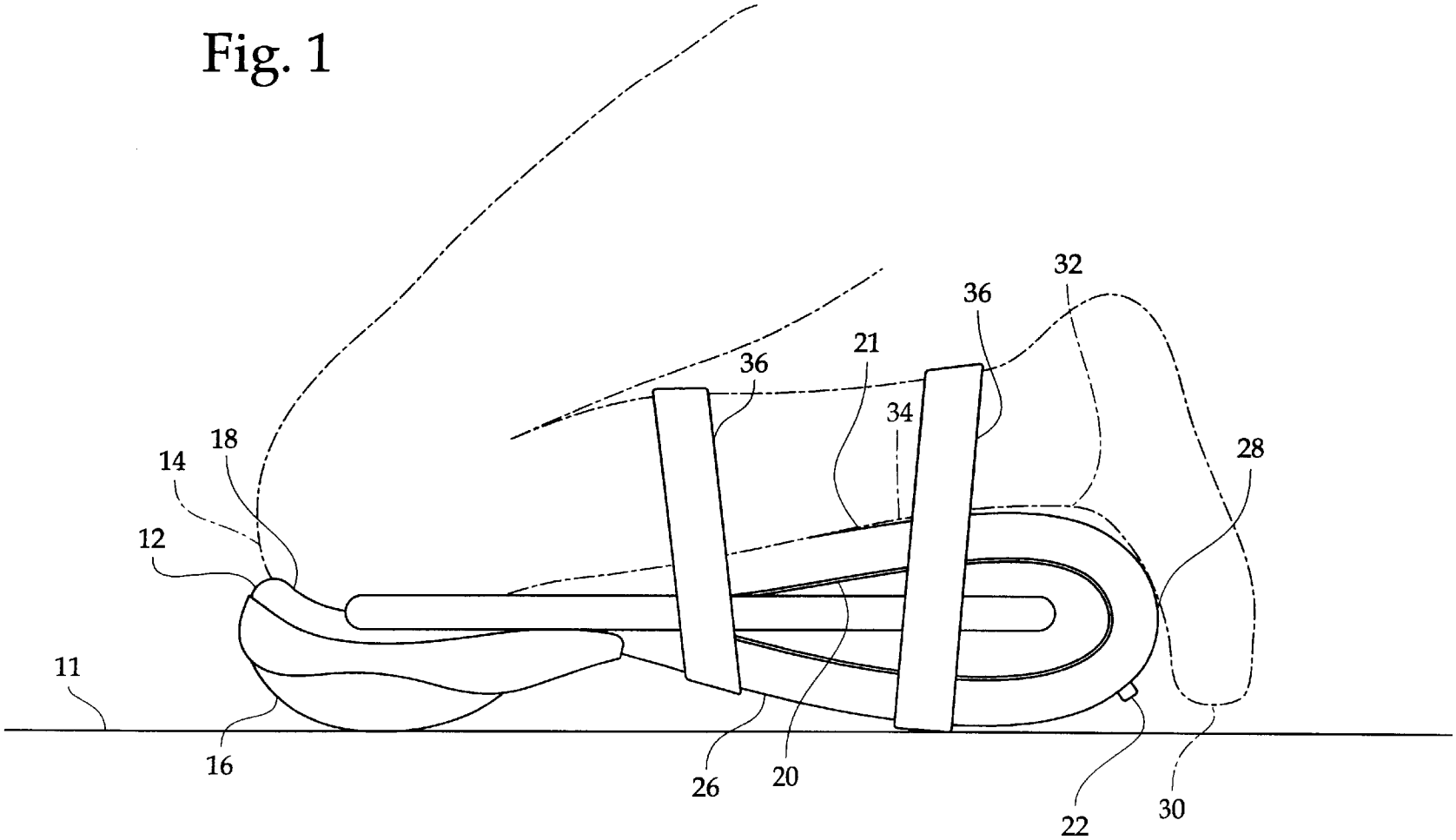
FIG. 1 is a perspective view of the preferred embodiment of the inflatable support for lower legs constructed in accordance with the principles of the present invention.

With reference now to the drawings, and in particular, to FIGS. 1 through 4 thereof, the preferred embodiment of the new and improved inflatable support for lower legs embodying the principles and concepts of the present invention and generally designated by the reference number 10 will be described. The person with which the invention is used, may be referred to herein as an individual, worker, user, and person. Such terms may be used interchangeably herein.

Specifically, it will be noted in the various figures that the device relates to an inflatable support for lower legs for protecting a person's knees and shins while kneeling on a hard ground surface 11. In its broadest context, the device consists of a knee support, a lower leg and foot support, and a pair of straps. Such components are individually configured and correlated with respect to each other so as to attain the desired objective.

The knee support 12 is adapted for receiving a knee 14 therein. The knee support 12 includes a rigid outer shell 16 for positioning on a hard surface and a padded inner layer 18 to provide comfort to the knee 14.

Figure 4:
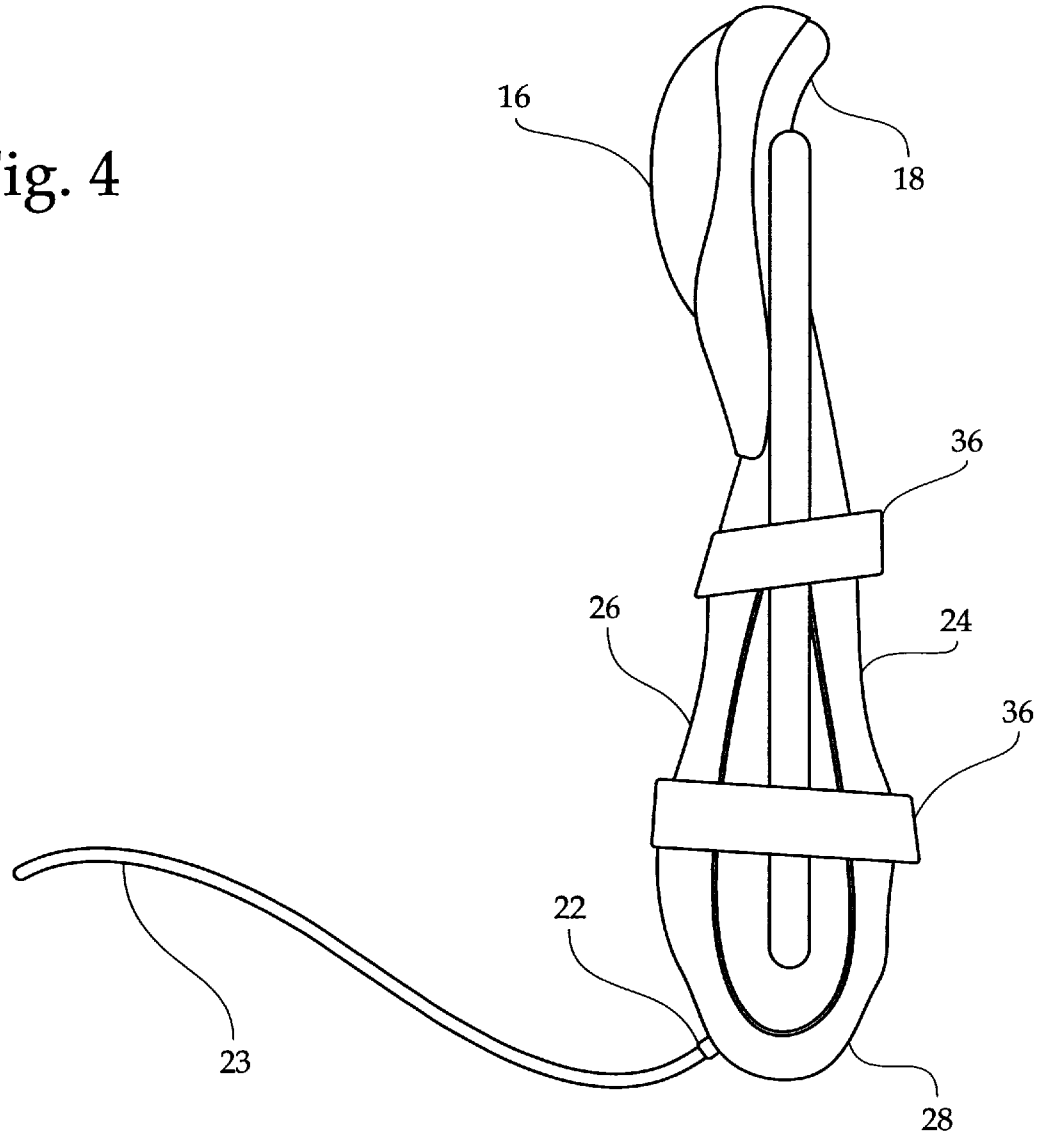
FIG. 4 is a side elevation view of the present invention.

The lower leg and foot support 20 is secured to the knee support 12. The lower leg and knee support 20 is comprised of a tubular member capable of being filled with a selected material. In one embodiment, the tubular member can be filled with air. In another embodiment, the tubular member can be filled with water. In this embodiment, the tubular member is capable of holding hot water, which can provide added therapy to the lower leg and foot. The tubular member has a valve 22 in communication with a hollow interior. The hollow interior is inflatable and pressurizable so that the tubular member so inflated is capable of supporting the weight of an individual, and distributing that weight evenly upon a large area of the leg of that individual. The valve 22 allows air or water to be added to or removed from the tubular member. FIG. 4 illustrates an air hose 23 connected with the valve 22.

The tubular member is arranged in a matrix defining an upper shin support 21, a lower floor support 26, and an inner ankle support bend 28 positionable within an arch between a foot 30 and an ankle 32. Th inner ankle support bend 28 distributes weight upon the foot and inner ankle, to keep the majority of the weight of the user from being supported by the toes. In addition, the size of the tubular member, and configuration thereof may be adjusted so that the inner ankle support bend 28 provides maximum support to the ankle, wherein the toes are actually elevated above the ground surface, as seen in FIG. 1, or wherein partial support is provided, and the toes contact the ground surface and support some weight.

Figure 2:
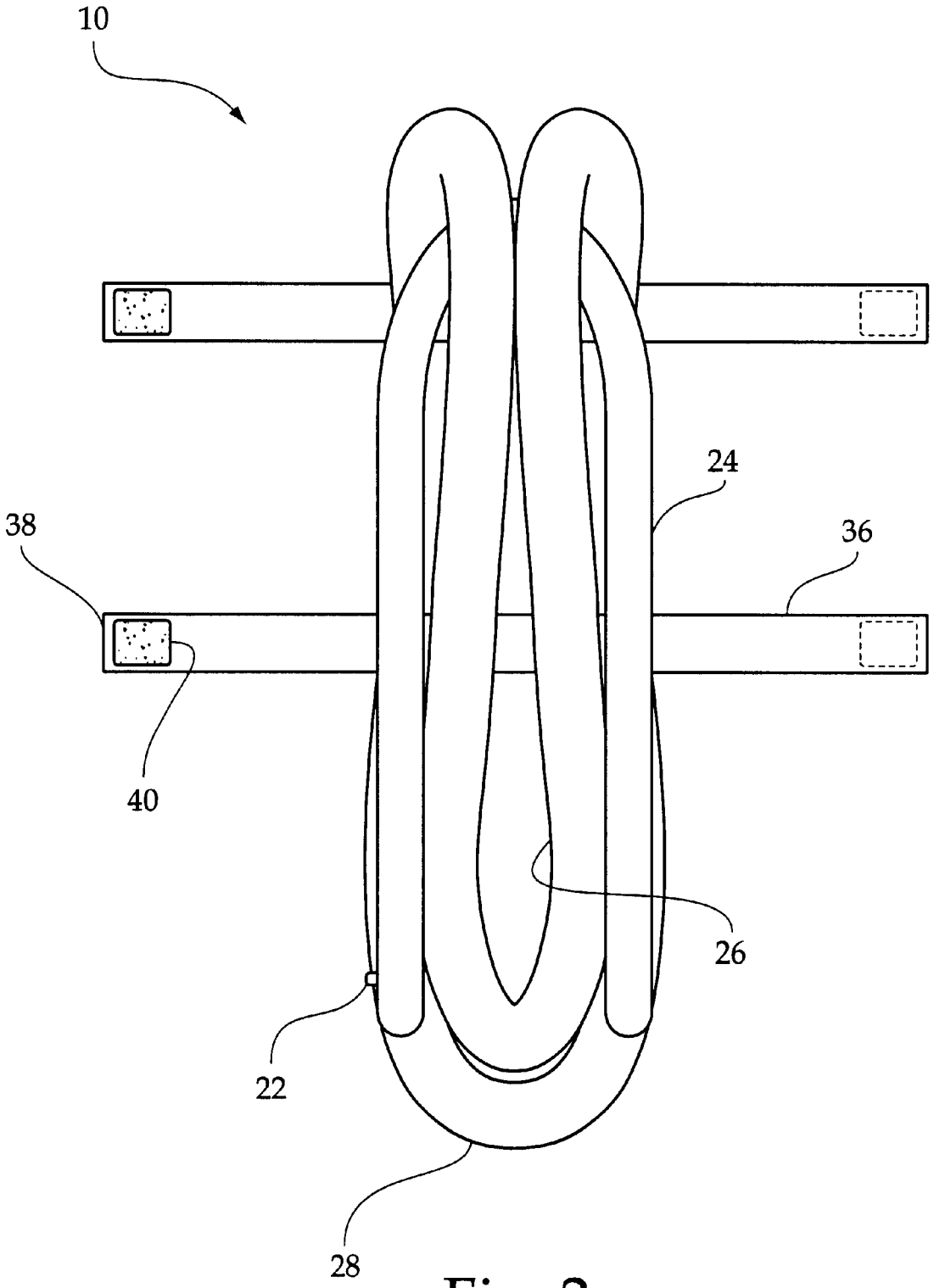
FIG. 2 is a bottom plan view of the present invention.
Figure 3:
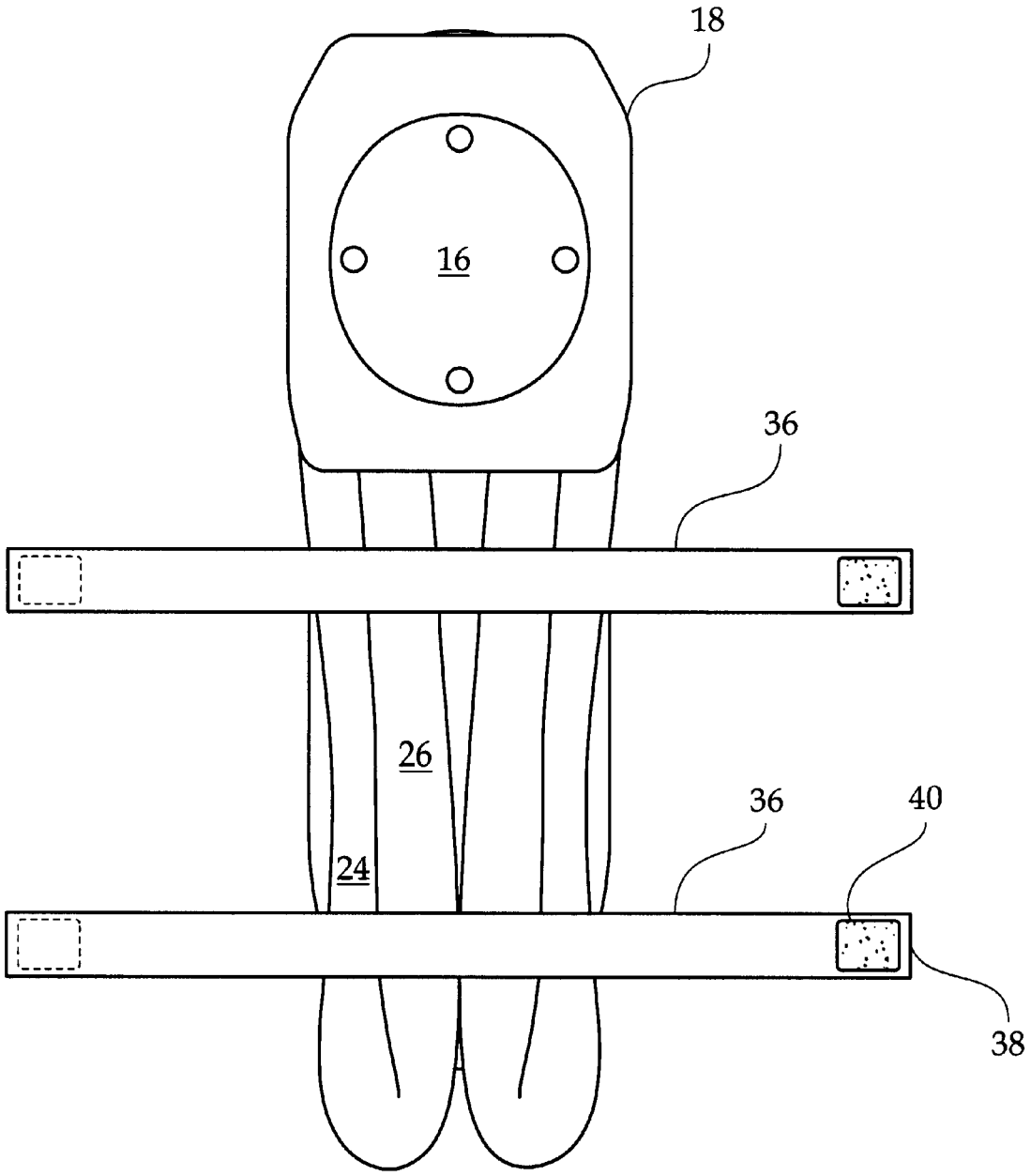
FIG. 3 is a top plan view of the present invention.

The tubular member is depicted as an inflatable ring, similar to a tire inner tube, which has been bent to create four nearly parallel members, as best seen in FIG. 2. However, it can be appreciated that the tubular member can be formed in other manners, while still providing the upper shin support, lower floor support, and inner ankle support. The tubular member is positionable along the lower leg 34 and foot 30 to evenly distribute the weight thereof as applied when in a kneeling position. It should be noted though, that a covering, perhaps forming part of the knee support or extending therefrom, may extend along the tubular member, such that it covers the lower floor support 26, and protects the tubular member. Accordingly, that covering would prevent the tubular member from actually contacting the ground surface, and as such would prevent punctures and other damage to the tubular member.

The pair of leg straps 36 are secured to and/or around the lower floor support 26 of the lower leg and foot support 20. The pair of leg straps 36 each have opposed ends 38 extending outwardly from the lower floor support 26. The opposed ends 38 each have hook and loop fastener patches 40 disposed thereon for engaging one another once the pair of leg straps 36 have been wrapped around the lower leg 34.

According to the preferred embodiment, the device may also include a heat bladder 25, which may have an inlet valve 27. The heat bladder 25 extends substantially between the knee support 12 and the inner ankle support bend 28. The heat bladder 25 is configured so as to transmit heat to the user. This can be accomplished in a number of ways. Preferably, the heat bladder is fillable with a heat absorbing medium through a heat medium filling valve 27, such that the heat bladder 25 is intially "charged" with the heat absorbing medium, which gradually releases heat to the user/worker. The heat absorbing medium can be any liquid, gas, gel, or even granular solid which has a high specific heat—such as hot water, or ammonia. In addition, the heat bladder 25 can be fuel based system, wherein fuel is generated and released to the user/worker.

Referring the FIG. 1, the heat bladder 25 can be positioned such that it directly contacts both the tubular member, and the knee 14 of the user/worker. Further the leg straps 36 can be configured so that they both contact the heat bladder 25, and are capable of conducting heat therefrom to the back of the leg of the user/worker.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. An inflatable support for lower legs for protecting a person's knees, shins, and feet while kneeling on a hard surface comprising, in combination:

a knee support adapted for receiving a knee therein, the knee support including a rigid outer shell for positioning on a hard surface and a padded inner layer to provide comfort to the knee;

a lower leg and foot support secured to the knee support, the lower leg and knee support being comprised of a tubular member capable of being filled with a selected material, the tubular member having a valve exposing a hollow interior, the tubular member being arranged so as to define an upper shin support, a lower floor support, and a ankler supporting bend positionable within an arch between a foot and an ankle, the tubular member being positionable fully along the lower leg and foot to evenly distribute the weight thereof as applied when in kneeling position; and a pair of leg straps secured to the lower floor support of the lower leg and foot support, the pair of leg straps each having opposed ends extending outwardly from the lower floor support, the opposed ends each having hook and loop fastener patches disposed thereon for engaging one another once the pair of leg straps have been wrapped around the lower leg.

2. An inflatable support for lower legs for protecting a person's knees and shins while kneeling on a hard surface comprising, in combination:

a knee support adapted for receiving a knee therein; and a lower leg and foot support secured to the knee support, the lower leg and knee support being comprised of a tubular member capable of being filled with a selected material, the tubular member being arranged so as to define an upper shin support, a lower floor support, and an ankle supporting bend positionable within an arch between a foot and an ankle, the tubular member being positionable along the lower leg and foot, extending fully between the foot and knee, to evenly distribute the weight thereof as applied when in kneeling position.

3. The inflatable support for lower legs as set forth in claim 2, wherein the knee support includes a rigid outer shell for positioning on a hard surface and a padded inner layer to provide comfort to the knee.

4. The inflatable support for lower legs as set forth in claim 2, wherein the tubular member has a valve in communication with a hollow interior, such that the tubular member is inflatable and pressurizable by the user.

5. The inflatable support for lower legs as set forth in claim 2, and further including a pair of leg straps secured to the lower floor support of the lower leg and foot support to secure the leg against the knee support, shin support, and ankle supporting bend.

6. The inflatable support for lower legs as set forth in claim 5, wherein the pair of leg straps each have opposed ends extending outwardly from the lower floor support, the opposed ends each having hook and loop fastener patches disposed thereon for engaging one another once the pair of leg straps have been wrapped around the lower leg.

7. The inflatable support for lower legs as recited in claim 2, further comprising a heated bladder, extending along the tubular member, for imparting heat the user directly and by heating the tubular member.

8. The inflatable support for lower legs as set forth in claim 7, wherein the knee support includes a rigid outer shell for positioning on a hard surface and a padded inner layer to provide comfort to the knee.

9. The inflatable support for lower legs as set forth in claim 8, wherein the tubular member has a valve in communication with a hollow interior, such that the tubular member is inflatable and pressurizable by the user.

10. The inflatable support for lower legs as set forth in claim 9, and further including a pair of leg straps secured to the lower floor support of the lower leg and foot support to secure the leg against the knee support, shin support, and ankle supporting bend.

11. The inflatable support for lower legs as set forth in claim 10, wherein the pair of leg straps each have opposed ends extending outwardly from the lower floor support, the opposed ends each having hook and loop fastener patches disposed thereon for engaging one another once the pair of leg straps have been wrapped around the lower leg.

* * * * *